United States Patent [19]

Gagliardo et al.

[11] Patent Number: 4,503,915

[45] Date of Patent: Mar. 12, 1985

[54] PROPORTIONING SYSTEM

[75] Inventors: John P. Gagliardo, Shrewsbury; Albert J. Pruneau, Worcester, both of Mass.

[73] Assignee: Feecon Corporation, Westboro, Mass.

[21] Appl. No.: 597,191

[22] Filed: Apr. 4, 1984

Related U.S. Application Data

[63] Continuation of Ser. No. 354,549, Apr. 3, 1982, abandoned.

[51] Int. Cl.[3] ..... A62C 35/00

[52] U.S. Cl. ..... 169/15; 137/599; 251/107; 239/310; 239/124; 222/43; 222/510

[58] Field of Search ..... 169/13, 14, 15, 24, 169/44; 222/41–43, 48, 52, 57, 135, 136, 145, 482, 510, 481; 137/101.11, 599; 251/107; 239/310, 583, 124, 574

[56] References Cited

U.S. PATENT DOCUMENTS

| | | | |
|---|---|---|---|
| 1,441,675 | 1/1923 | Garvey | 222/482 |
| 1,781,298 | 9/1927 | Prutzman . | |
| 2,611,439 | 12/1952 | Faulkner . | |
| 2,627,280 | 2/1953 | Adelson | 137/599 |
| 3,135,467 | 12/1964 | Greenman . | |
| 3,232,585 | 5/1966 | Garbarino . | |
| 3,337,195 | 3/1967 | Farison . | |
| 3,369,705 | 5/1968 | Curtis . | |
| 3,369,755 | 12/1968 | Roden . | |
| 3,441,249 | 4/1969 | Aslan | 137/599 |
| 3,628,727 | 12/1971 | Gjerde | 239/124 |
| 3,733,028 | 5/1973 | McVey . | |
| 3,770,198 | 11/1973 | Mihara . | |
| 3,811,660 | 5/1974 | Cole . | |
| 3,846,515 | 11/1974 | Williamson . | |
| 3,893,591 | 7/1975 | Hockmuth . | |

OTHER PUBLICATIONS

Feecon Catalog, p. 6, (May 1980).

*Primary Examiner*—H. Grant Skaggs
*Attorney, Agent, or Firm*—Blodgett & Blodgett

[57] ABSTRACT

System for distributing secondary fluid into a primary fluid, as in a fire-fighting system, including a proportioner having plurality of passages, each of which is sized for the amount of secondary fluid necessary for a particular one of a plurality of fire-fighting elements.

8 Claims, 4 Drawing Figures

PROPORTIONING SYSTEM

This is a continuation of co-pending application Ser. No. 354,549 filed Apr. 3, 1982 and now abandoned.

BACKGROUND OF THE INVENTION

In the operation of certain kinds of apparatus, such as that used in fire-fighting, it is common practice to mix a secondary fluid (such as foam) with a primary fluid (such as water). In many applications, it is important that the exact amount of foam be added to the water for two reasons: first of all, the foam/water combination is most effective when an exact proportion is used. Secondly, using too much foam is a wasteful procedure, since the foam is quite expensive. This problem is exacerbated in the case of a plurality of fire-fighting nozzles, because of the difficulty of selecting the certain amount of foam necessary for each of the nozzles. The secondary fluid or foam is usually added to the water by use of an eductor consisting of a venturi through which water flows. The foam is introduced at the neck of the venturi and is sucked into the main flow in accordance with the induction principle. An eductor works best with a fixed amount of main primary fluid flow. It is difficult to put the eductor in the main stream of water flowing through the pump, because nozzles are being opened and closed in the system as the fire-fighting takes place. For that reason, it is common practice to have a branch circuit flowing from the outlet of the pump to the inlet of the pump and to place the eductor in that branch circuit which contains a small amount of recirculated primary fluid. In order to control the amount of foam that is introduced into the eductor, a variable resistence passage has in the past been inserted between the foam tank and the eductor. When the fire-fighting nozzles are being used, one of the firemen must stand at this device and continuously reset the passage opening to an amount commensurate with the demand on foam by the nozzles then in use. Since the nozzles are cut in and out during the fire-fighting operation, it is necessary for him to reset the resistence passage in accordance with a chart which is mounted on the device. This represents a rather complex situation, since it requires that one of the fire-fighting personnel be devoted entirely to this function. Furthermore, it is difficult for him to reset accurately, particularly if the nozzles are being shut on and off (or having their flow rates changed) at a rapid rate, as is sometimes the case in the case of a fire. One situation in which this problem arises is in the case of a crash truck used at an airport which has a larger number of nozzles in various parts of the truck for performing different functions in fighting an airplane fire. In other words, even if the services of a fireman is devoted solely to the function of regulating the amount of foam introduced into the flow of primary fluid, he is still not able to do so accurately. These and other difficulties experienced with the prior art devices have been obviated in a novel manner by the present invention.

It is, therefore, an outstanding object of the invention to provide a proportioning system for use in fire-fighting equipment, which system automatically regulates the introduction of secondary fluid into a primary fluid flow.

Another object of this invention is the provision of a proportioning system consisting of a plurality of flow regulating passages, each passage being sized for a particular piece of fire-fighting equipment.

A further object of the present invention is the provision of a proportioning system, including a plurality of fire-fighting nozzles and including means for introducing foam into a primary fluid without human supervision in the exact amount necessary at any given moment, depending on the number of nozzles in use.

It is another object of the instant invention to provide a fire-fighting system with automatic regulation of the introduction of foam, which system is inexpensive to manufacture, which is simple in construction, and which is capable of a long life of useful service with a minimum of maintenance.

SUMMARY OF THE INVENTION

In general, the invention has to do with a proportioning system that includes a pump connected to a source of primary fluid and to a plurality of distribution elements. A recirculation branch joins the outlet of the pump to its inlet and is itself connected to a source of secondary fluid. A proportioner is provided having an input chamber connected to the source of secondary fluid and an output chamber joined to the recirculation branch. A plurality of valves join the input chamber to the output chamber, each valve having a passage with a size corresponding to the secondary fluid requirements of a particular distribution element.

More specifically, the system is used in fire-fighting equipment and the distribution elements are nozzles, each of which has its own control valve. Means is provided to operate the first-named valves when the nozzle control valves are operated. The valves are clustered in a circle and a disk is mounted on the housing. Adjustable stops are carried on the disk to limit valve motion.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
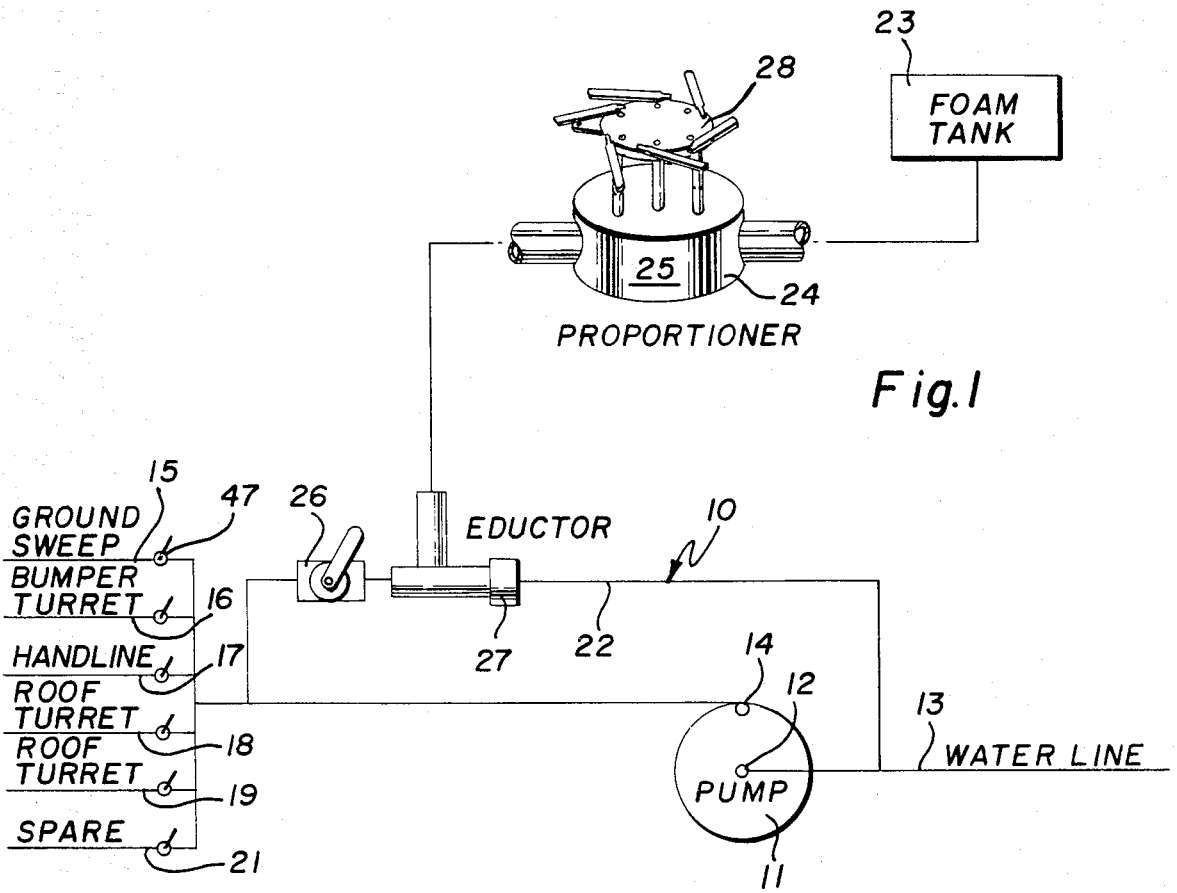
FIG. 1 is a schematic view of a proportioning system incorporating the principles of the present invention.

Referring first to FIG. 1, which best shows the general features of the invention, the proportioning system, indicated generally by the reference numeral 10, is shown as having a pump 11. The pump has an inlet 12 that is connected to a source 13 of primary fluid; in the preferred embodiment, the primary fluid is water for use in extinguishing a fire. The pump has an outlet 14 connected to distribution elements 15, 16, 17, 18, 19, and 21. In the preferred embodiment, the distribution elements are nozzles, including a GROUND SWEEP nozzle 15, a BUMPER TURRET nozzle 16, a HANDLINE nozzle 17, two ROOF TURRET nozzles 18 and 19, and a SPARE nozzle 21.

A recirculation branch 22 joins the outlet 14 of the pump to the inlet 12. The branch includes a shutoff valve 26 and an eductor 27 of the venturi type, the eductor being connected through a proportioner 24 to a source 23 of secondary fluid. In the preferred embodiment, the secondary fluid is a foaming agent.

The proportioner 24 consists of a generally cylindrical housing 25 having an input chamber 29 (See FIG. 3) joined to the source 23 of secondary fluid and an outlet chamber 31 joined to the eductor 27. A disk 28 is mounted over the housing.

Figure 2:
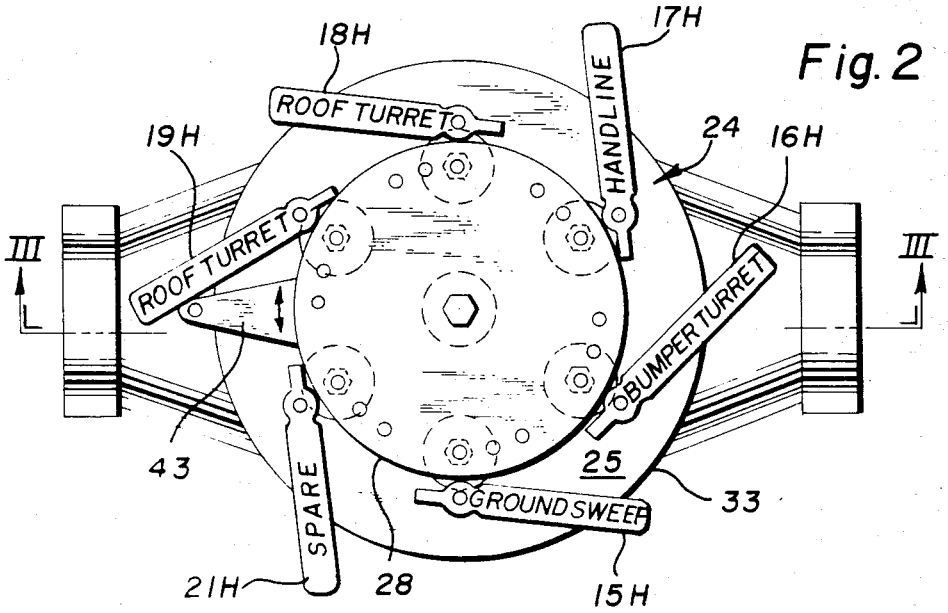
FIG. 2 is a top plan view of a proportioner forming part of the system.
Figure 3:
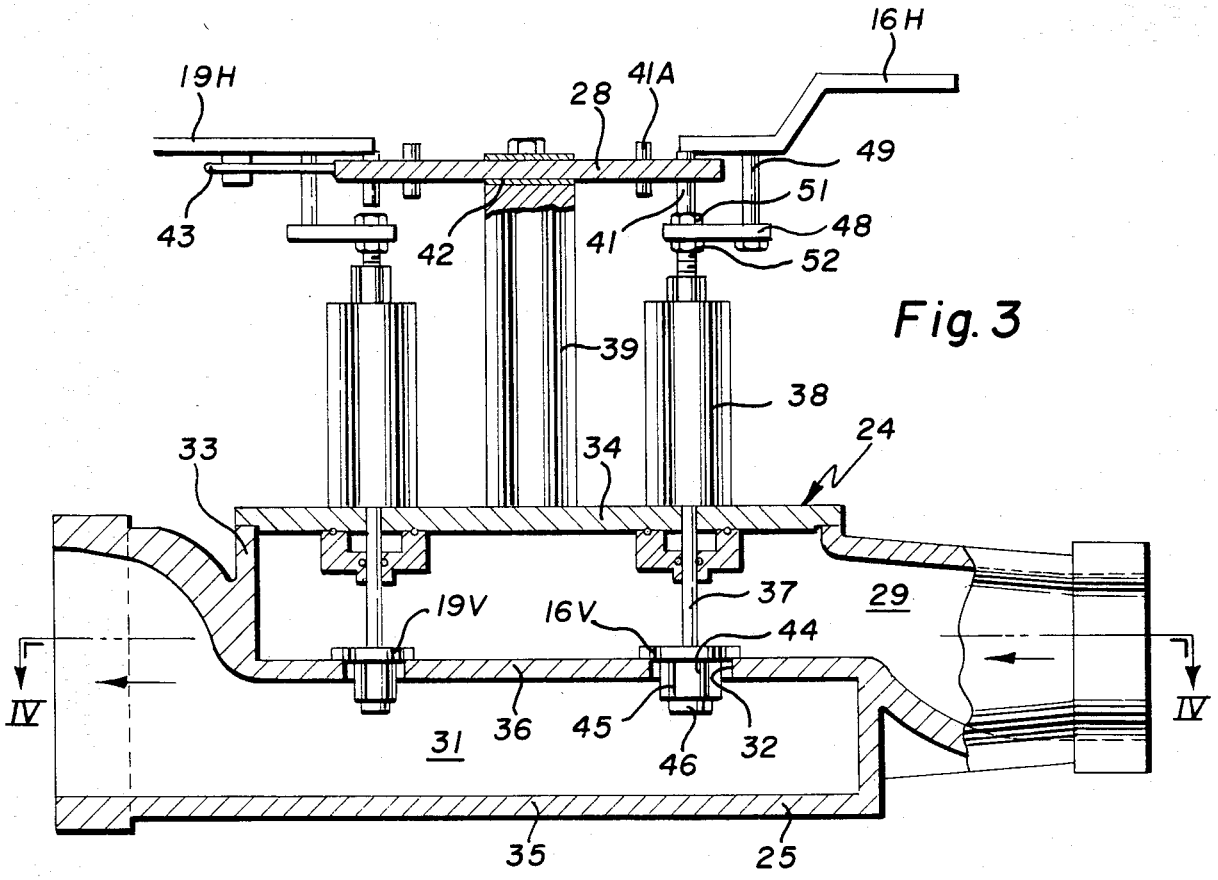
FIG. 3 is a vertical sectional view of the proportioner taken on the line III—III of FIG. 2.
Figure 4:
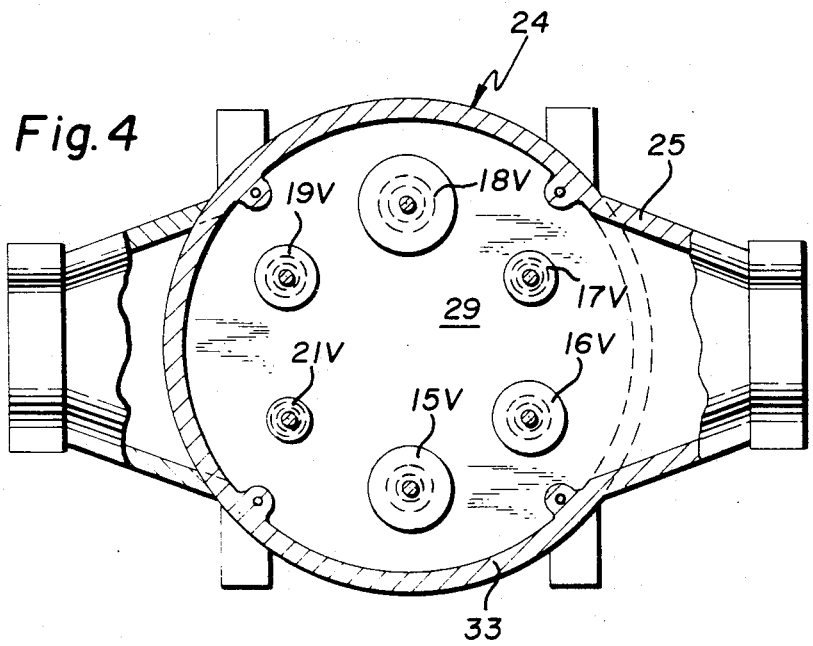
FIG. 4 is a horizontal sectional view of the proportioner taken on the line IV—IV of FIG. 3.

FIGS. 2, 3, and 4 show the details of the proportioner 24. The input chamber 29 is joined to the output chamber 31 by a plurality of valves 15V, 16V, 17V, 18V, 19V, and 21V. Each valve has a passage that is sized in accordance with the secondary fluid needs of one of the distribution elements. For instance, the valve 16V has a passage 32, when in the open mode, that allows exactly the proper amount of foaming agent to satisfy the needs of the BUMPER TURRET nozzle 16. As is best evident in FIG. 4, the valves are arranged in a circle and the housing 25 has a cylindrical side wall 33 that is concentric with the valves. A removable top wall 34 encloses the upper end of the housing and the input chamber 29, while an integral bottom wall 35 defines the output chamber 31. The input and output chambers are separated and defined by an intermediate wall 36 which is provided with orifices or passages 32 for the valves.

Each valve has a stem extending through the top wall 34 and an actuator is carried on the outer surface of the top wall surrounding the stem. For instance, the valve 16V has a stem 37 provided with an actuator 38. In the preferred embodiment, the actuator is an annular electrical solenoid with the stem passing entirely through it. A post 39 is mounted on the top wall concentrically of the valves and the horizontal disk 28 is rotatably mounted on the upper end of the post; the disk, therefore, is parallel to and spaced from the top wall. A set of adjustable stops 41 are carried close to the periphery of the disk in alignment with the valve stems. Another set of stops 41A (also equal in number to the valves) is angularly related to the stops 41 to move into alignment with the valve stems when the disk is rotated. In the preferred embodiment, a third set of stops is also provided.

A set of handles 15H, 16H, 17H, 18H, 19H, and 21H is provided, each being mounted on a threaded portion of a valve stem above the corresponding solenoid. For instance, the stem 37 of the valve 16V is provided with the handle 16H. A laterally-extending arm 48 is clamped at its inner end to the stem 37 by means of nuts 51 and 52. The outer end of the arm is joined to the handle 16H by a vertical shaft 49. Each handle can swing about the shaft from a position entirely outside the periphery of the disk 28 (as shown in FIG. 2) to a position in which one end lies over a stop 41 (as shown in FIG. 3).

As is best shown in FIG. 3, each passage 32 is defined by a cylindrical orifice. Each valve also includes a head that fits snugly in the passage when the valve is in closed position. For instance, the valve 16V has a head 44 for engagement with the seat or passage 32. The head 44 is provided with stepped cylindrical portions 45 and 46 to permit a selection of flow gap between the passage and the head when the valve is in open position. The actuators 38 are each connected to a switch on a distribution element. The distribution elements or nozzles are each provided with a control valve to regulate the flow through the nozzle of the mixture of primary and secondary fluid.

The operation of the proportioning system will now be readily understood in view of the above description. When the pump 11 is operated, the primary fluid is drawn from the source 13 into the inlet 12. The pump discharges the fluid from the outlet under pressure and it passes to the distribution elements or nozzles 15, 16, 17, 18, 19 and 21. If one of the control valves 47 is opened, the fluid is projected in a regulated stream in accordance with conventional fire-fighting practice. In order to introduce a secondary fluid, such as a foaming agent, into the stream, the shutoff valve 26 is opened. This causes a portion of the stream emerging from the discharge of the pump 11 to flow through the recirculation branch 22 and, more specifically, through the valve 26 and the eductor 27. The flow of fluid through the eductor causes it to draw secondary fluid from the source 23 and the proportioner 24. The amount of secondary fluid thus mixed into the fluid in the recirculation branch 22 (and, therefore, into the main fluid stream passing through the pump) is determined by the number of valves that are open and the sizes of the passages in those open valves. When a control valve 47 is opened, the valve of the proportioner that corresponds to that nozzle is opened and the amount of secondary fluid that is needed by that nozzle is introduced into the main flow. By operating the arm 43, the disk 28 is rotated in the bushing 42, so that another set of stops 41A, etc., are aligned with the valve stems 37. When the actuator 38 is energized, the valve stem 37 is drawn upwardly, thus opening the valve. The upper end of the stem 37 engages the threaded stop 41 and the setting or adjustment of the stop determines the gap between the head 44 of the valve and the seat or passage 32. In order to operate the valves manually (as may be desirable occasionally), it is only necessary to lift upwardly on the handle 16H (in the case of valve 16V) to move the stem upwardly into engagement with the stop 41. The handle is then rotated so that its end lies over the upper end of the stop and the valve is locked in open position. If the disk has been rotated to bring another set of stops 41A into position over the valves, a different flow gap will be available at each valve for regulating the amount of secondary fluid available at the valves are opened. Normally, the various sets of stops will be selected to bring the different portions 45, 46, etc., into operative, flow-regulating relationship to the seat or passage 32. These sets of stops would be adjusted to give, for instance, a mixture of 3%, 6%, or 12% secondary fluid in the primary fluid at all of the nozzles.

It can be seen, then, that the present invention permits an automatic adjustment of the amount of secondary fluid introduced into the main stream as the number type, and size of nozzles are taken in and out of service. The adjustment takes place almost instantaneously and is accomplished accurately. This means that there is no waste of foaming agent by the use of excess agent, nor is there any possibility of using less than an effective amount. At the same time, a manual over-ride is available in case of emergency; even such manual operation can be accomplished very quickly, since the valve settings have already been set up. The operator only needs to know which nozzles have been cut in or cut out.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Proportioning system including a pump whose inlet is connected to a source of primary fluid and whose outlet is connected to a plurality of distribution elements and including a recirculation branch joining the outlet to the inlet and having a source of secondary fluid, comprising:

a proportioner having a housing with an input chamber joined to the source of secondary fluid and with an output chamber joined to the recirculation branch, a plurality of valves joining the input chamber to the output chamber, each valve corresponding to one of the distribution elements and having a passage that is sized to correspond to the secondary fluid requirements of its distribution element, wherein the valves are arranged in a circle, wherein the housing has a cylindrical side wall concentric with the said circle, wherein the housing has a top and a bottom wall at the ends of the side wall and an intermediate wall extends across the side wall to divide the housing into the said input chamber and the output chamber, wherein the valves have stems extending through the top wall, wherein actuators are mounted on the outer surface of the top wall, each actuator being operatively connected to one of the valve stems, wherein a post is mounted on the top wall concentrically of the valves, wherein a disk is mounted on the outer end of the post, so that it lies parallel to and spaced from the said top wall, and wherein a set of adjustable stops is mounted on the disk, each stop being in alignment with a valve stem.

2. Proportioning system as recited in claim 1, wherein the disk is rotatable on the post, and wherein another set of stops that is equal in number to the valves angularly related the first-mentioned set of stops to move into alignment with the valve stems when the disk is rotated.

3. Proportioning system as recited in claim 1, wherein a set of handles are attached to the valves for manual operation, the handles being operable in connection with the stops to lock the valve in a selected position.

4. Proportioning system as recited in claim 1, wherein each passage is an orifice, wherein the valve also includes a head that fits securely in the passage when the valve is in a closed position, and wherein the head is provided with stepped cylindrical portions to permit a selection of flow gap between the passage and the head when the valve is in open position.

5. Proportioning system as recited in claim 1, wherein the valves are provided with electrical solenoid actuators that are connected to switches on the distribution elements.

6. Proportioning system as recited in claim 1, wherein the distributor elements are nozzles having control valves, the switches being associated with the control valves, so that opening a control valve causes one of the valves of the proportioner to open and to introduce an added amount of the secondary fluid into the primary fluid, the amount added being equal to the amount of secondary fluid used by the particular nozzle.

7. Proportioning system including a pump whose inlet is connected to a source of primary fluid and whose outlet is connected to a plurality of distribution elements and including a recirculation branch joining the outlet to the inlet and having a source of secondary fluid, comprising:

a proportioner having a housing with an input chamber joined to the source of secondary fluid and with an output chamber joined to the recirculation branch, a plurality of valves joining the input chamber to the output chamber, each valve corresponding to one of the distribution elements and having a passage that is sized to correspond to the secondary fluid requirements of its distribution element, wherein the valves are arranged in a group, wherein the housing has a side wall surrounding the said group, wherein the housing has a top and a bottom wall at the ends of the side wall and an intermediate wall extends across the side wall to divide the housing into the said input chamber and the output chamber, wherein the valves have stems extending through the top wall, wherein actuators are mounted on the outer surface of the top wall, each actuator being operatively connected to one of the valve stems, wherein a post is mounted on the top wall adjacent the valves, wherein a plate is mounted on the outer end of the post, so that it lies parallel to and spaced from the said top wall, and wherein a set of adjustable stops is mounted on the plate, each stop being in alignment with a valve stem.

8. Proportioning system including a pump whose inlet is connected to a source of primary fluid and whose outlet is connected to a plurality of distribution elements and including a recirculation branch joining the outlet to the inlet and having a source of secondary fluid, comprising:

a proportioner having a housing with an input chamber joined to the source of secondary fluid and with an output chamber joined to the recirculation branch, a plurality of valves joining the input chamber to the output chamber, each valve corresponding to one of the distribution elements and having a passage that is sized to correspond to the secondary fluid requirements of its distribution element, wherein the valves are arranged in a group, wherein the housing has a side wall surrounding the said group, wherein the housing has a top and a bottom wall at the ends of the side wall and an intermediate wall extends across the side wall to divide the housing into the said input chamber and the output chamber, wherein the valves have stems extending through the top wall, wherein actuators are mounted on the outer surface of the top wall, each actuator being operatively connected to one of the valve stems, wherein a plate is mounted so that it lies parallel to and spaced from the said top wall, and wherein a set of adjustable stops is mounted on the plate, each stop being in alignment with a part of a valve.

* * * * *